United States Patent [19]

Bosse

[11] 4,170,050

[45] Oct. 9, 1979

[54] METHOD OF MAKING LOBULAR INTERNALLY AND EXTERNALLY THREADED INSERT

[75] Inventor: Robert W. Bosse, Englewood Cliffs, N.J.

[73] Assignee: Groov-Pin Corporation, Ridgefield, N.J.

[21] Appl. No.: 913,469

[22] Filed: Jun. 7, 1978

[51] Int. Cl.[2] ..... B21H 3/04; B23G 7/00

[52] U.S. Cl. ..... 10/10 R; 10/27 R; 10/152 R; 72/104

[58] Field of Search ..... 10/10 R, 27 R, 152 R, 10/152 T; 72/104, 105, 108; 85/46, 48; 151/22

[56] References Cited

U.S. PATENT DOCUMENTS

| | | | |
|---|---|---|---|
| 2,656,740 | 10/1953 | Bedker | 72/108 X |
| 3,195,156 | 7/1965 | Phipard | 10/10 R |
| 3,398,625 | 8/1968 | Ansingh | 10/10 R X |
| 3,434,168 | 3/1969 | Bonacci | 10/10 R X |

FOREIGN PATENT DOCUMENTS

| | | | |
|---|---|---|---|
| 2314526 | 10/1974 | Fed. Rep. of Germany | 10/152 R |

*Primary Examiner*—E. M. Combs
*Attorney, Agent, or Firm*—Arthur B. Colvin

[57] ABSTRACT

The present invention relates to an improved method for economically manufacturing lobular internally and externally threaded self-tapping inserts. The method is characterized by the novel application of a conventional roll forming apparatus of the type including two cylindrical driven thread forming dies in combination with a specially configured lobular elongated stock material, resulting in the provision of a multiplicity of longitudinally spaced-apart, externally threaded increments which may thereafter sequentially be drilled, tapped and severed from the stock material.

3 Claims, 12 Drawing Figures

METHOD OF MAKING LOBULAR INTERNALLY AND EXTERNALLY THREADED INSERT

BACKGROUND OF THE INVENTION

1. Field of the Invention

The present invention is directed to the field of forming insert members, and more specifically to headless insert members which are externally and internally threaded, the insert members being of the lobular, i.e. non-cylindrical, configuration.

2. The Prior Art

As conducive to an understanding of the present invention, it should be noted that the affixation of an insert member of the self-tapping type requires the application of substantial driving torque. It is known in the self-tapping screw art to provide, in lieu of a conventional cylindrical-bodied article, an article of lobular cross-section, (i.e. incorporating, in cross-section, portions which extend further from the longitudinal axis of the insert, separated by other portions closer to the longitudinal axis). Such inserts, after application to a workpiece, provide holding power nearly equal to the holding power of a cylindrical insert but may be applied with substantially lower driving torque, reduced incidence of chip formation etc.

By way of example, there is disclosed in U.S. Pat. No. 3,195,156 a self-tapping device of lobular cross-section, the device incorporating a driving head adapted to be engaged by a screw driver, chuck or the like, to provide the application of driving torque thereto. The noted patent describes a method or methods for producing the external threads of a formed lobular blank, which method involves interposing the shank portion of a formed blank between a pair of flat or curved thread forming dies which form an external thread simultaneously along the entire length of the blank.

The method in accordance with the noted patent requires that the blank be headed, relying upon the under surface of the head as a guide for locating the blank in the course of the thread formation. As a result, the procedure, while useful for forming headed, self-tapping members, such as screws, etc. is inapplicable, on any practical basis, for the formation of headless, self-tapping members, such as insert members.

While it is possible, of course, to take a formed headed fastener member fabricated in accordance with the method of the above referenced patent and thereafter sever the head, drill an internal bore and tap the bore to form an insert, it is obvious that such procedure is wasteful of material, and more importantly, requires the subjection of individual articles to sequential operations, with the attendant difficulties in handling.

As a result of the complicated and wasteful operations required to form lobular insert members in accordance with known methods, inserts commercially available have essentially universally been of the cylindrical type since cylindrical inserts may be readily manufactured using conventional techniques.

Thus, despite the known advantages of lobular construction and despite the availability of various headed self-tapping fasteners of lobular configuration, non-headed lobular inserts are, for all intents and purposes, commercially unavailable.

SUMMARY OF THE INVENTION

The present invention may be summarized as directed to a method for economically manufacturing non-headed self-tapping lobular inserts. Briefly stated, the method includes forming an elongated rod or bar into a specific desired lobular cross-sectional configuration, forming on the shaped rod a multiplicity of longitudinally spaced-apart chamfer or bevel portions by an orbital or helicoid movement of the rod, which movement employs the side surfaces of the rod as a guide, to provide lobular chamfers which comprise smooth continuations of the external lobular configuration, progressively advancing the thus formed beveled rod through a conventional two die rolling machine in such manner that the rod is caused to describe a helicoid path as it advances, thereby to form a thread on the peripheral portions of the rod and on adjacent portions of the bevels.

The thus formed externally threaded elongate rod may be processed in conventional manner in a screw machine which drills increments of the rod, taps the drilled increments, and thereafter severs the drilled and tapped increments from the rod.

The method described enables, for the first time, the provision in economical fashion of headless inserts having lobular external cutting surfaces, the formation of the inserts involving minimal wastage of material and requiring no machinery other than conventional roll form and screw forming machines.

Additionally, the method, for the first time, enables the external lobular surfaces of the inserts to be processed while the material from which the inserts are formed is still in integral condition, the conventional drilling and tapping operations being carried out on the integral member, individual inserts being severed from the integral member only after they have been completely formed, whereby production is substantially simplified.

Accordingly, it is an object of the present invention to provide an improved method for forming self-tapping, headless lobular inserts.

A further object of the invention is the provision of a method of the type described wherein a substantial length of material may have its external surface formed to the desired lobular configuration and externally threaded, enabling the internal drilling and tapping operations to be carried out progressively after formation of the external surface has been completed, whereby individual increments are not separated from the whole until after the drilling and tapping operations have been completed.

To attain these objects and such further objects as may appear herein or be hereinafter pointed out, reference is made to the accompanying drawings, forming a part hereof, in which.

Figure 1:
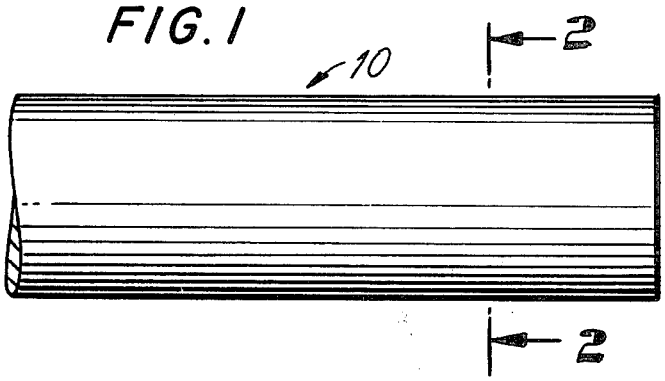
FIGS. 1 and 2 are, respectively, a side elevation and a cross-sectional view of a stock material after the first forming step.
Figure 2:
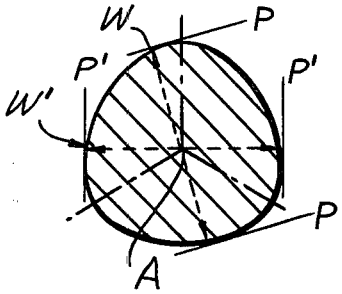

Referring now to the drawings, there is shown in FIG. 1 a length of stock material 10 which, as best seen in FIG. 2, has been formed by any desired means, e.g. by a drawing operation, into a lobular configuration. The specific cross-sectional configuration is critical to the successful practice of the method in accordance with the invention and requires the presence of an odd number of lobes more than one, e.g. 3, 5, 7, 9, etc., and further requires that the width of the formed stock, measured between two parallel planes engaging opposed surfaces be a constant. Thus the width, as represented by the line W between opposed parallel planes P, P must equal the width as represented by the line W' between any other two parallel planes P', P' touching opposed surfaces of the material (FIG. 2). By thus forming the initial starting material, it is made possible to process the stock for the forming steps hereinafter set forth, including the formation of lobular chamfers or bevels at longitudinally spaced positions and the formation of threads on the external surface of the stock, in an essentially conventional centerless two die rolling machine employing a pair of driven dies.

Insofar as known, rolling machines of the type noted, and which will be more fully described hereinafter, have never been used on a centerless basis with materials other than round stock. It has unexpectedly been discovered that a rolling mill of the type described, when utilized in conjunction with lobular material as hereinabove defined, is enabled to form in the periphery of the material chamfers and threads whereby an entire length of stock material may, in a roll forming operation, be provided with chamfers and external threading, which chamfers and threading maintain the lobular configuration of the original stock material.

More particularly, the invention is predicated upon the discovery that rolling machines employing two constantly spaced cylindrical driven dies are enabled to engage against the peripheral faces of lobular material as hereinabove defined, and to advance said lobular material between the rolling die faces in a helicoid path, which path is defined by the interengagement between the die faces and peripheral surface portions of the stock material, whereby the chamfers and the external surfaces of the stock material are formed in respective and separate roll forming operations, with the threads and chamfers accurately maintaining the lobular configuration of the formed components.

In contrast, if the axis of the stock material were maintained on a fixed line during processing, as is the case with roll forming devices processing cylindrical stock, then the profile of the material would be distorted and returned in large measure to a cylindrical profile and the advantage of a lobular, as opposed to cylindrical, insert would be substantially lost.

It is important to reemphasize that the advantages which enable an elongate starting material to be processed to provide the lead chamfers and external threading can be achieved only where the starting material is of lobular configuration as hereinabove defined, i.e. of constant width dimension wherever measured.

Figure 4:
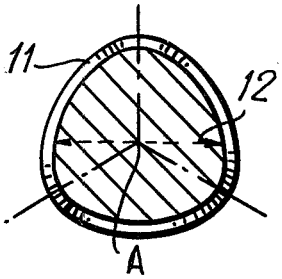

As a first step in the manufacturing operation, a length of stock material, preferably round, is processed as by drawing, to assure the described lobular configuration (FIGS. 1 and 2). The lobular material shown in FIGS. 1 and 2 is thereafter processed to provide a series of longitudinally spaced-apart chamfers or bevels 11, which chamfers or bevels, as seen in FIG. 4, form an accurate replica of the lobular configuration of the stock material.

The chamfers or bevels 11 are formed by feeding the stock material 10 through an opposed pair of rollers of a conventional cylindrical two die rolling machine.

By way of example and without limitation, a suitable rolling machine is made by Kinefac Corporation of Worcester, Mass. and identified as the MC-5-F KINE-ROLLER (registered trademark of Kinefac Corp.) The roll forming apparatus and dies of the above referenced rolling device are fully described in the catalog of the noted organization.

Briefly, the rolling device for forming the chamfers 11 is comprised of a pair of cylindrical rollers which are driven in the same direction. The specific arrangement or orientation of the rollers may vary from instance to instance. For example, for the formation of the bevel configuration shown in FIG. 4, the rollers may be mounted in a progressively converging orientation, with the axes in coplanar alignment. With the noted type of rolling device, a helicoid raised bead may be formed on the surface of the rollers. The rollers, at their closest point of approach are disposed with their major body portions spaced a distance corresponding to the width W of the lobular stock material.

The chamfer formed on the external surface of the stock material is provided by a raised bead configuration formed on and extending beyond the outermost surface of the rolling dies, the spacing of the raised bead portions at the nearest point of approach of the dies corresponding to the dimension 12 (see the line, FIG. 4). Since the rolling apparatus for forming the bevels or chamfers 11 and for forming the external threads 13 operate on essentially identical principles, a description of the bevel forming operation will suffice for an understanding of the thread forming operation, which is carried out in an essentially identical two cylinder rolling mill, the cylindrical rolling dies, in this latter instance, having their external surface configured to roll threads rather than bevels or chamfers on the external surface of the stock material.

Referring now more specifically to FIGS. 9 through 12, there are shown a pair of cylindrical rolling dies 15, 16 which are longitudinally elongated and oriented, as is conventional, and which have their axes of rotation 17, 18 oriented in a toe-in relationship. The dies are driven in the direction of the arrows 19, 20. Each of the noted figures depicts the position of the parts after a 90° rotation of the stock material, whereby there is shown a complete cycle.

The stock material 10 is supported on a guide block or roller 21. The illustrations of FIGS. 9 through 12 depict the apparatus at the closest point of approach of the respective dies 15, 16.

As will be seen, the support surface 21 is so oriented that a line between the axes 17, 18 of the dies is disposed a perpendicular distance from the support surface which is greater than one half the width but less than the entire width of the stock material.

As may be appreciated by a comparison of FIGS. 9 through 12, the driving rollers will, in the course of chamfer formation, cause the stock material to be rotated in the direction of the arrow 22, which rotation causes a point on the center axis A to be moved in a helicoid path. The path traversed by the axis A may be readily traced by reference to the progressive views of FIGS. 9, 10, 11 and 12.

Figure 9:
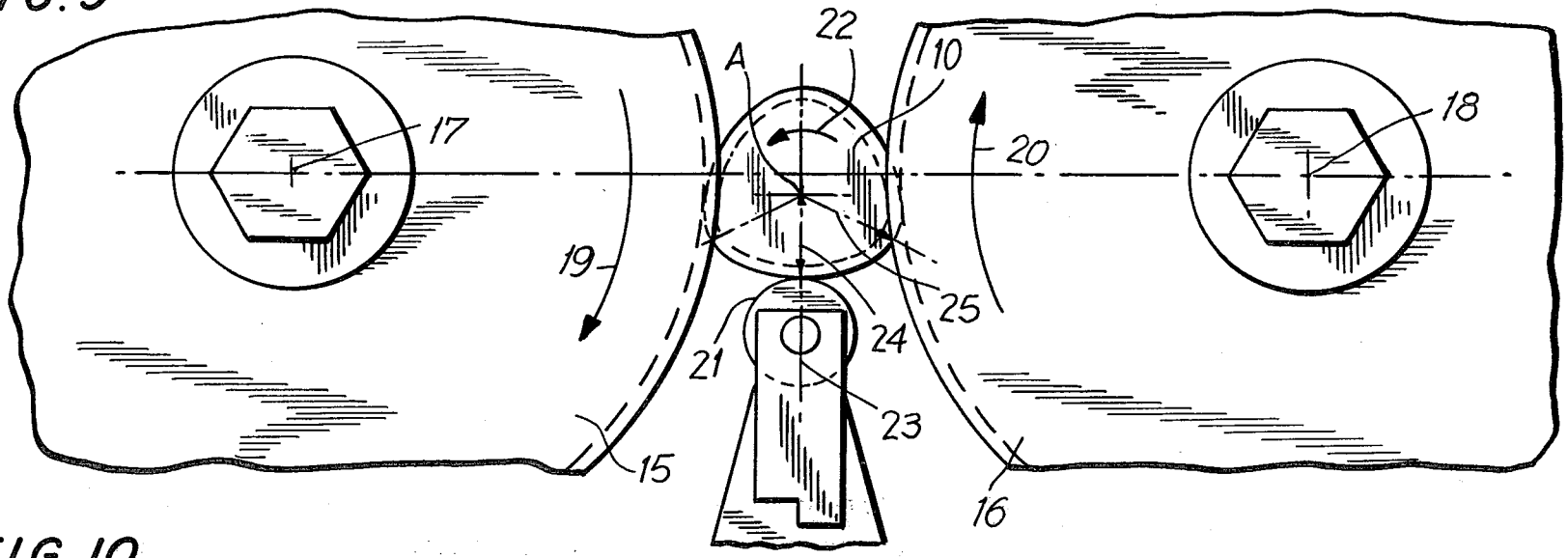
FIGS. 9 through 12 are diagrammatic end elevational views of the stock material in the course of the chamfering and external thread forming operation, showing, progressively, the sequence of positions occupied by the material in the course of manufacture.

In FIG. 9, the axis A is aligned with the center line 23 which is disposed half way between the axis of rotation of the dies 15, 16 at the closest point of approach thereof.

Figure 10:
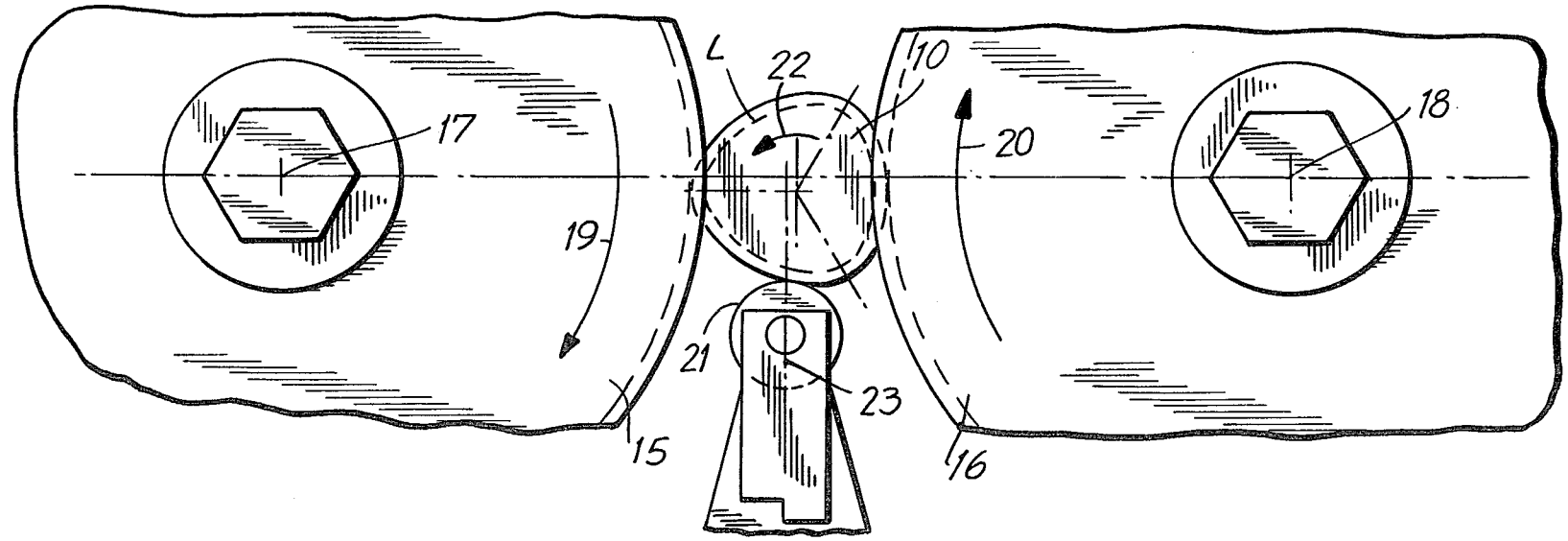

Rotation of the stock to the position of FIG. 10 will have caused the central axis A of the lobular stock material to have been shifted to the right of the center line 23 and slightly upwardly therefrom.

Figure 11:
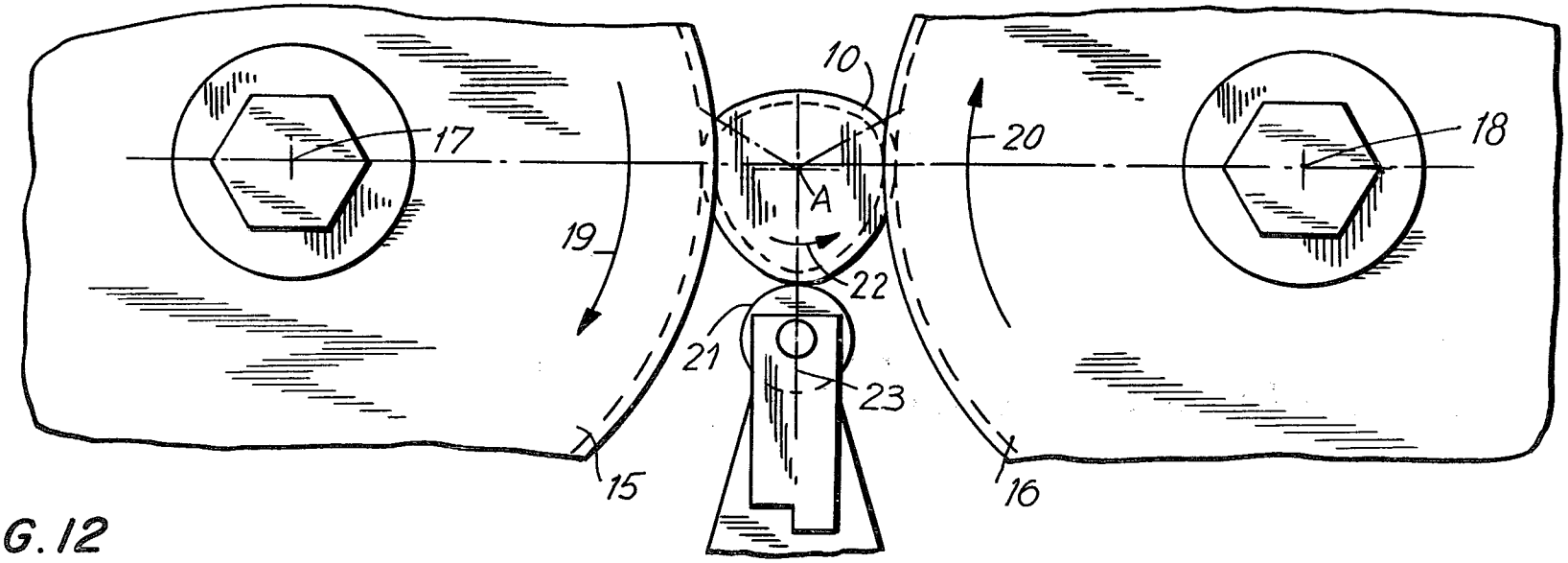

Continued rotation to the position of FIG. 11 will have caused the axis A to return to the center line 23 at a position which is raised with respect to the starting position of FIG. 9 by a distance corresponding to the difference between the distance 24, representing the spacing of a flat component of the lobe from the axis and the distance 25, representing the spacing of a peak of the lobe from the center axis A of the stock material.

Figure 12:
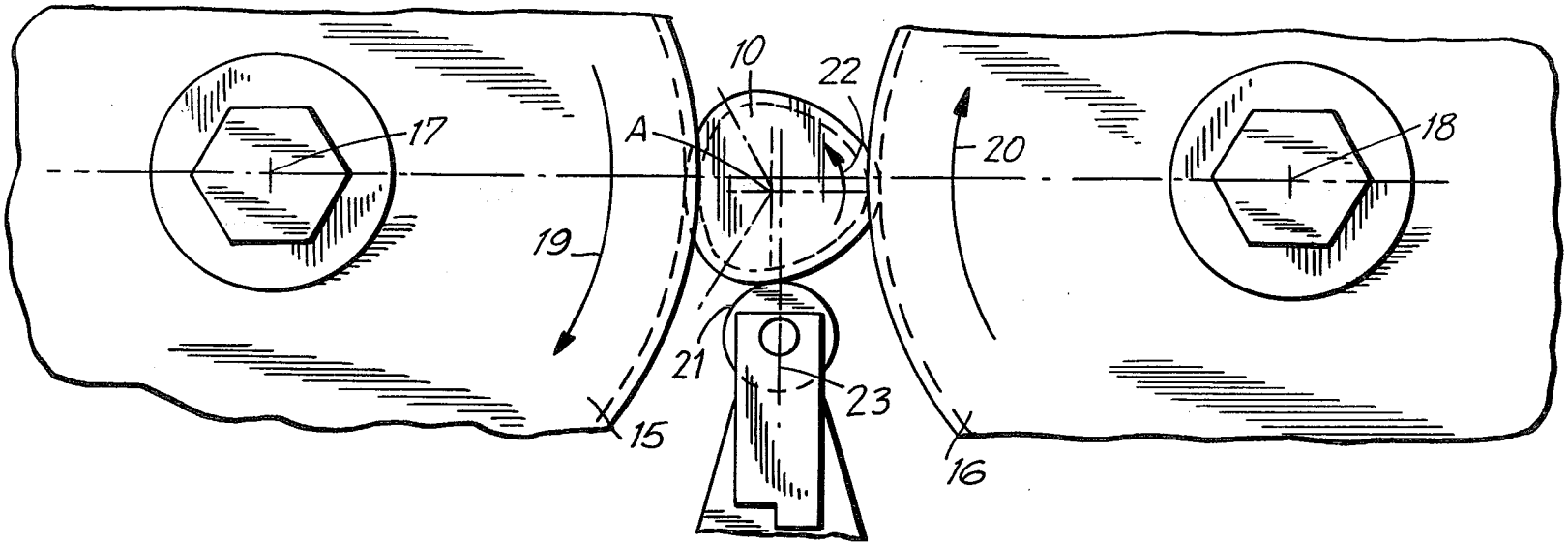

The starting material as shown in FIG. 12 has been advanced a further increment of 90° whereat the axis A is depicted to the left of the center line 23, it being understood that a further 90° rotation will bring the stock material back to the starting position of FIG. 9.

It will be observed that the indented land L (representing the chamfer or the base of the threads) depicted by the broken line shown in FIGS. 9 through 12, provides an accurate replica, albeit on a reduced diameter, of the lobular profile or pattern of the stock material. The tracing of the profile on the land area L comprises such accurate replica by virtue of the fact that the cylindrical dies have induced the helicoid movement of the stock material in the course of forming, such helicoid path corresponding to the dimensional differences between the flats and crests of the peripheral lobular configuration.

It will be appreciated that the helicoidal path is not precisely circular in transverse section.

At this junction it should be noted that the formation of threads or chamfers, as is conventionally practiced on a cylindrical stock material by a two die cylindrical roll forming machine, may be effected in a series of different but conventional manners, utilizing known roll die configurations and orientations. For example, in lieu of the die conformation described above (cylindrical dies toed-in and having helicoid bead), the dies may have their axes skewed, in which case the surface pattern on the dies may be comprised of a series of progressively increasing diameter spirals.

Since there exist in two cylinder roll forming technology a great number of available and conventional cylindrical die configurations and arrangements, any one of which may be suitably adapted for use in the roll forming of the lobular stock material, no attempt need here be made exhaustively to detail the suitable die assemblies. Common to all of the satisfactory configurations and arrangements, however, is the use of a pair of driven cylindrical roll forming dies and a support surface which maintains the stock material to be formed an appropriate distance from the dies to roll form the desired pattern on the surfaces of the lobular stock.

Figure 3:
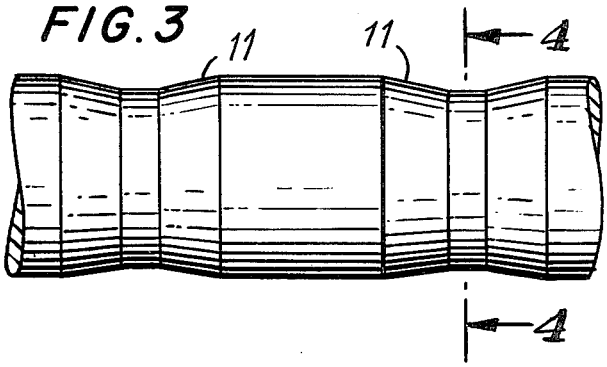
FIGS. 3 and 4 are, respectively, a side elevational and a cross-sectional view after a second forming step has been carried out.
Figure 8:
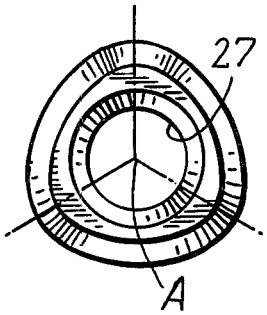

As hereinabove noted, the result of the first roll forming operation is the provision of lobular chamfers 11, as shown in FIGS. 3 and 4. After formation of the chamfers, the material is fed again through a roll forming apparatus, as diagrammatically depicted in FIGS. 9 through 12, wherein the pattern formed on the cylindrical rolling dies is such as to produce on the exterior surface thread configuration 13 which, as noted and shown in FIG. 8, is itself lobular.

Figure 5:
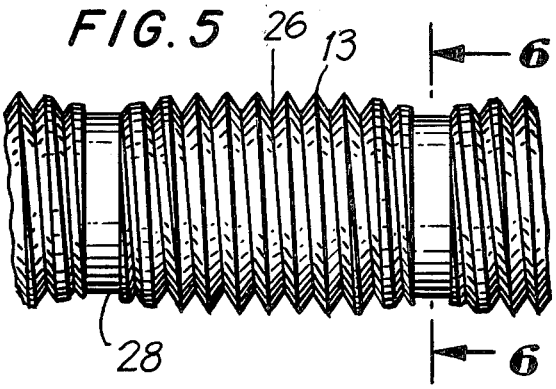
FIGS. 5 and 6 are, respectively, a side elevational and a cross-sectional view of the material after the external thread forming portion has been completed.
Figure 6:
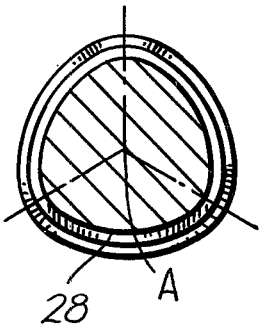
Figure 7:
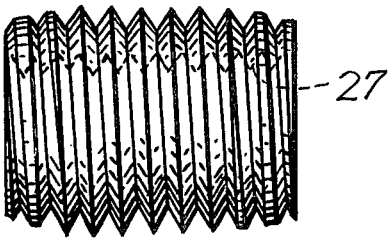
FIGS. 7 and 8 are, respectively, a side elevational and an end elevational view of a finished insert member.

It will be appreciated from FIGS. 5 and 7 that the depth to which the threads 13 are formed should be sufficient to extend at least part way, and preferably completely, into the chamfers 11, whereby the chamfers may form a lead surface, facilitating the forming of threads in the workpiece receiving the insert.

The threaded and chamfered stock material shown in FIG. 5 is next processed by conventional screw machines, which progressively form axial bores 27, tapping the thus formed bores, enabling tapped externally and internally threaded increments to be progressively severed by transverse cuts formed in the areas 28 between the chamfers.

The finished insert is shown in FIG. 7.

It will be understood that the various forming operations resulting in the provision of the insert may be carried out while the stock material is relatively soft, the inserts being thereafter hardened in accordance with the desired end use thereof.

From the foregoing it will be recognized that there is provided in accordance with the method of the present invention, a means for forming the entire external surface of an extended length of stock material into the configuration required for forming a lobular insert. The manufacturing procedure involves conventional roll forming machines and the roll forming step or operation does not require the presence of a head to guide the material in the course of its formation. By forming the external configurations required of lobular inserts on an integral piece of stock material, it is possible to perform subsequent operations, such as drilling and internal tapping by conventional methods without handling, feeding and orienting small preformed components as was heretofore required, resulting in substantial manufacturing economies.

While the method of the invention has been described in conjunction with the manufacture of inserts incorporating an outer threaded portion for reception in a workpiece and an inner threaded portion, it will be recognized that the method is adaptable also to the manufacture of other non-headed externally threaded devices, such as set screws, studs and the like. Accordingly the term "insert" is to be construed, where the context permits, to encompass such other devices.

As will be readily appreciated by the skilled worker in the art made conversant with the above disclosure, numerous variations of the procedure may be made without departing from the spirit of the invention. Accordingly, the invention is to be broadly construed within the scope of the appended claims.

Having thus described the invention and illustrated its use, what is claimed as new and is desired to be secured by Letters Patent is:

1. The method of making a lobular, internally and externally threaded insert which comprises:

(a) forming a length of metallic stock material into a uniform lobular cross-sectional configuration characterized in that:

1. an odd number of arcuate lobes more than one are defined of said material; and
2. said lobes are of uniform circumferential extent; and
3. the width of said material is substantially constant;

(b) forming a plurality of longitudinally spaced-apart, circumferentially indented lobular chamfer portions on said material, said chamfer portions being disposed normal to the longitudinal axis of said material and forming continuations of the profile of said material;

(c) progressively advancing said material between a driven pair of cylindrical thread forming dies, the peripheries of said dies at the closest point of approach thereof being spaced apart a distance less than the width of said material, said dies being each in driving engagement with a different one of said lobes while said material is supported on a surface spaced from a line extending between the peripheries of said dies at said closest point of approach a distance greater than half but less than the entire width of said material, thereby to cause said material progressively to be advanced in a helical path while forming threads on said driven lobes and on parts of said chamfer portions without distorting the profile of said material at the crests of said threads;

(d) drilling progressive increments of said externally threaded material along a line coincident with the axis thereof while said increments are integral with said material;

(e) sequentially tapping said drilled increments of said material to form an internal thread therein; and (f) thereafter severing said drilled and tapped increments of said material by cuts formed transversely through said material along lines adjacent said chamfers.

2. The method in accordance with claim 1 wherein said lobular bevel portions are formed on said material by moving said material through an orbital path utilizing a roll forming device employing two cylindrical rolling dies engaging two lobular surfaces of said material.

3. The method of making a lobular externally threaded insert which comprises:

(a) forming a length of metallic stock material into a uniform lobular cross-sectional configuration characterized in that:

1. an odd number of arcuate lobes more than one are defined of said material; and
2. said lobes are of uniform circumferential and radial extent; and
3. the width of said material measured between parallel planes tangent opposed surfaces of said material is substantially constant; and (b) progressively advancing said material between a driven pair of cylindrical thread forming dies, the peripheries of said dies at the closest point of approach thereof being spaced apart a distance less than the width of said material, said dies each being in driving engagement with a different one of said lobes while said material is supported on a surface spaced from a line extending between the peripheries of said dies at said closest point of approach a distance greater than half but less than the entire width of said material, thereby to cause the said material progressively to be advanced in a helical path while forming threads on said driven lobes without distorting the profile of said material at the crests of said threads;

(c) drilling progressive increments of said externally threaded material along a line coincident with the longitudinal axis thereof while said increments are integral with said material;

(d) forming chamfers at spaced intervals along said material; and (e) thereafter severing increments of said externally threaded and internally drilled increments of said material by cuts formed transversely through said material along lines adjacent said chamfers.

* * * * *